United States Patent [19]

Gerbaud

[11] Patent Number: 5,042,223

[45] Date of Patent: Aug. 27, 1991

[54] ARTICLE POSITIONING CONTROL APPARATUS

[75] Inventor: Claude Gerbaud, Massy, France

[73] Assignee: Alcatel Satmam, Bagneux, France

[21] Appl. No.: 538,447

[22] Filed: Jun. 15, 1990

[51] Int. Cl.[5] ..... B65B 57/00; B65H 43/00

[52] U.S. Cl. ..... 53/55; 53/69; 53/284.3; 53/504

[58] Field of Search ..... 53/69, 67, 64, 71, 70, 53/77, 266 A, 504, 266.1, 284.3; 271/259, 258, 2, 111, 110, 199

[56] References Cited

U.S. PATENT DOCUMENTS

| | | | |
|---|---|---|---|
| 4,020,615 | 5/1977 | Irvine et al. | 53/266 A X |
| 4,573,673 | 3/1986 | Haug | 271/111 |
| 4,903,456 | 2/1990 | Meur | 53/69 |
| 4,932,188 | 6/1990 | Krasuski et al. | 53/266 A X |
| 4,962,623 | 10/1990 | Francisco | 53/54 |
| 4,962,624 | 10/1990 | Foster et al. | 53/266 A X |

OTHER PUBLICATIONS

Patent Abstracts of Japan, vol. 10, No. 105 (M-471)[2162], Apr. 19, 1986.

French Serch Report, Feb. 2, 1990, by Examiner Henrotte I.

*Primary Examiner*—James F. Coan

*Attorney, Agent, or Firm*—Sughrue, Mion, Zinn, Macpeak & Seas

[57] ABSTRACT

Apparatus for controlling the positioning of articles driven on a path comprises a first position detector mounted on the path upstream from a desired stop position for the articles on the path and a sensor for sensing displacement steps of the articles and triggered by the first position detector. The apparatus is characterized in that first detector is at a non-critical distance from the stop point, and in that it further includes a second position detector mounted at a distance which is known and referenced relative to the stop point, and means for deriving a stop-controlling parameter P during an initialization cycle using one of the articles driven along the path, on the basis of the number N of article displacement steps representing the known distance and on the basis of a number n of sensor steps measured between the article being detected by one of the two position detectors and then by the other. The invention is applicable to mail processing.

7 Claims, 1 Drawing Sheet

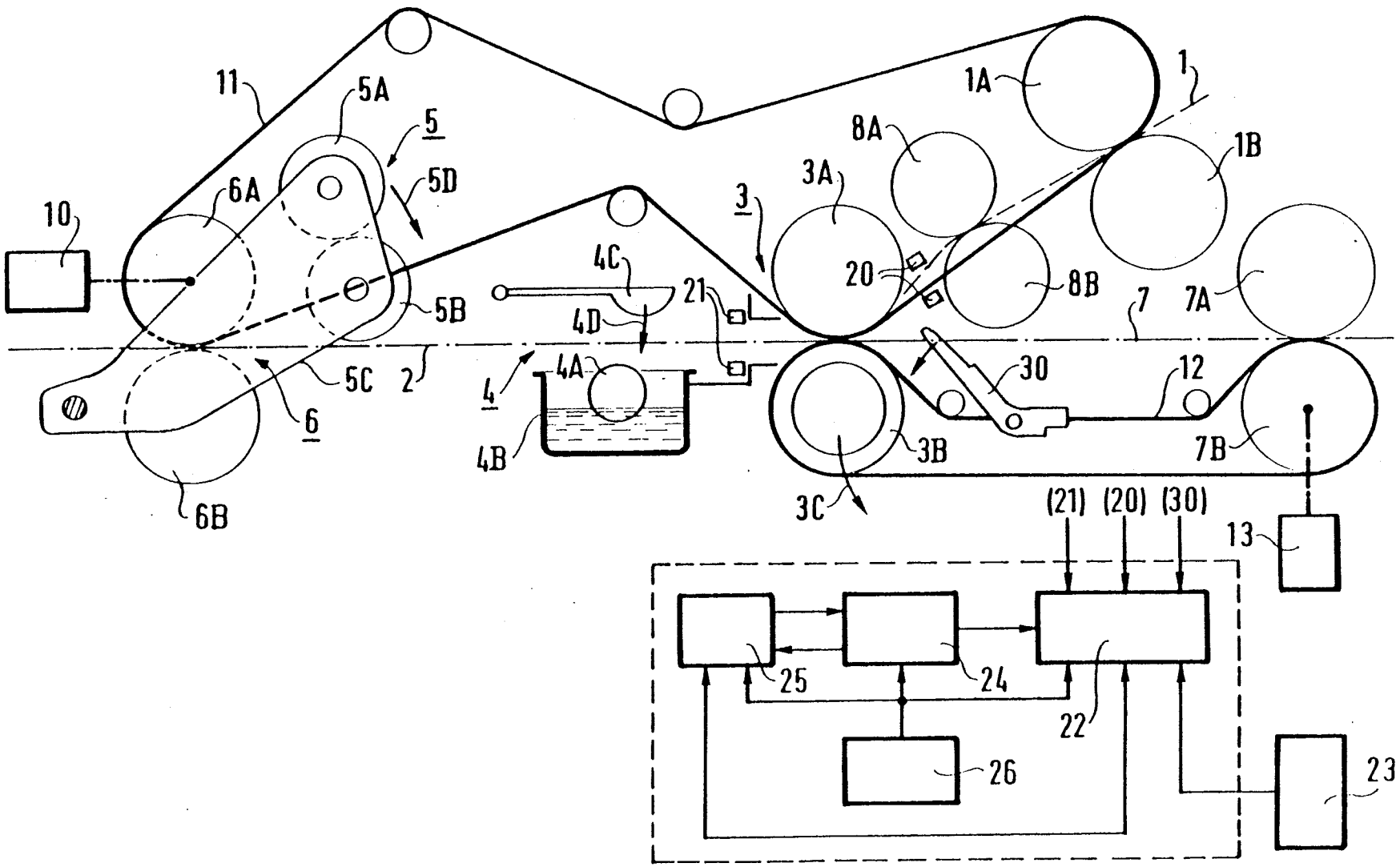
1
1A
1B
7
7A
7B
12
13
23
(21)
(20)
(30)
22
24
26
25
8A
8B
30
3B
3C
3A
20
3
21
4C
4D
4A
4B
4
5
5D
5B
5A
5C
2
6
6A
6B
11
10

ARTICLE POSITIONING CONTROL APPARATUS

The present invention relates to controlling the positioning of articles on a drive path, in particular for temporarily stopping each article in a defined accurate position for processing the articles.

Such control is necessary, in particular in mail processing machines. It enables envelopes to be positioned on their drive path, in particular for filling purposes and possibly for closure after flap moistening.

In conventional manner, the positioning control apparatus may comprise a position detector placed at the desired stopping position for one or other of the front and rear edges of each successive article. The detector then causes each article to be stopped at the moment it detects the appropriate edge of the article at its position. In order to take account of the time taken by the drive means to respond to such control and also of the fact that it is not always easy or even possible to place the detector in the precise stop location, another known solution consists in placing the position detector at a known distance upstream from the desired precise stop position. The position detector is then associated with count up or down means which it triggers, with said means being coupled to a sensor for sensing unit displacement steps of the articles, and being constituted either by a coder or else directly by a driving stepper motor. On reaching the number of pulses or steps that corresponds to the distance between the position of the position detector and the stop position, the drive means is stopped. This number is stored in a memory of an electronic circuit for controlling the displacements of articles on the path.

These prior devices require the position detector to be accurately positioned upstream from the stop position. The positioning of the detector is often adjusted during machine manufacture by means of adjustment equipment. This initial adjustment of the position of the detector in the machine which uses it makes it possible, in particular, to take account of the response characteristic of the detector, particularly when the detector is a lever, and to obtain a substantially identical response characteristic for the detectors of different machines of the same type. However, after the detector has been disassembled and reassembled on user premises, it is difficult to reproduce this initial adjustment in order to ensure subsequent satisfactory operation of the machine.

The object of the present invention is to avoid these drawbacks, and in particular to avoid the need to position a position detector accurately relative to the stop point.

The present invention provides an apparatus for controlling the positioning of articles on a path, the apparatus comprising means for driving the articles along the path, a first position detector mounted on the path upstream from a desired stop position, a sensor for sensing unit displacement steps of the articles, memory means for storing a control parameter P, and a displacement control circuit coupled to said first detector to be triggered thereby and to said sensor for causing an article to be stopped P sensor steps after triggering, the said apparatus being characterized in that first detector is mounted at a non-critical distance from said stop point, and in that it further includes a second position detector mounted on said path at a position which may be upstream or downstream from said first detector and from said desired stop point, but which is at a distance that is uniquely known and referenced relative to the stop point, said distance being equal to a number N of sensor steps from said stop point, and an initialization circuit including processor means coupled to the control circuit and to the memory means and also to control means for deriving said parameter P during an initialization cycle using one of the articles driven along the path, on the basis of said number N and on the basis of a number n of sensor steps measured between said article being detected by one of the two position detectors and then by the other, with the derived parameter P being loaded in the memory means.

The second position detector may be of the opto-electronic type. Since it does not control stopping, it may equally well be placed upstream from the first detector, between the first detector and the stop position, or downstream from the stop position. It makes it possible to drive the value of the control parameter P by causing one of the articles to pass both position detectors without stopping. Thereafter, the control circuit can then cause each article to stop in the proper position after detecting P steps from the moment the leading edge of the document passes the first position detector.

Other characteristics and advantages of the present invention appear from the following description made with reference to the accompanying drawing.

In the drawing, the sole FIG. represents an article processing machine fitted with apparatus in accordance with the present invention for controlling the positioning of articles on their path.

The machine shown is a mail processing machine for inserting documents into envelopes and for closing the envelopes. The general organization of the machine is conventional and is summarized briefly below. The machine is fitted with control apparatus of the present invention.

The machine includes an envelope path comprising an empty envelope feed portion or path 1 and an envelope processing portion or path 2. An envelope-stuffing station 3, a flap moistening station 4, a closing station 5, and an ejection station 6 are mounted one after the other along the processing path 2. A document path 7 conveys folded documents to be inserted into the envelopes that are successively presented to the stuffing station 3.

The stuffing station 3 has wheels 3A and 3B mounted on either side of the envelope path where the portions 1 and 2 meet. The moistening station 4 has a moistening element 4A mounted beneath the path 2 in a feed tank 4B, and has an associated pivoting deflector 4C mounted above the path 2 and caused to move in the direction of arrow 4D. The closing station 5 has a pair of presser rolls 5A and 5B mounted at the ends of a pair of pivoting arms 5C. The pair of rolls is disposed to move along arrow 5D between a retracted position with both rolls above the path 2 and a closure position in which the rolls lie on either side of the path. The ejection station 6 has wheels 6A and 6B mounted to press against each other on either side of the path 2.

Two pairs of wheels 1A and 1B and 8A and 8B are also shown pressed together from opposite sides of the path 1, as is another pair of wheels 7A and 7B pressing against each other from opposite sides often document path 7.

The wheels 1A, 3A, and 6A above the paths 1 and 2 are driven simultaneously by a reversible stepper motor 10 by means of a coupling belt 11. The wheels 8A and 8B are idler wheels pressed against each other. The wheel 7B beneath the path 7 and the lower wheel 3B of the stuffing station are coupled together by a belt 18 driven by a different motor 13. The wheel 3B is mounted on a freewheel mechanism and is also urged in the direction of arrow 3C so as to be capable of pressing against the wheel 3A or of being retracted to a position where it does not press thereagainst. Only one of the motors 10 and 13 is driven at a time. While the wheel 3B presses against the wheel 3A, it enables envelopes to be driven while the motor 10 is being driven, and it enables document insertion to be completed while the motor 13 is being driven. When in its retracted position, it enables document insertion to be commenced with the document being caused to advance by the wheel 7B being driven by the motor 13.

It is also specified that the envelopes arrive at the stuffing station with their flaps open in order to receive suitably folded documents. Each envelope present at the stuffing station has its body on the path 2 while its flap is retained on the path 1 between the wheels 8A and 8B which are mounted for this purpose close to the wheels 3A and 3B. The envelope body is also caused to open between the wheels 3A and 3B in order to facilitate document insertion.

It is also specified that after it has been filled, each envelope is driven along the path 2 by the wheels 3A and 6A. Its flap is folded down by the rolls 5A and 5B which are put into the closure position when the envelope reaches them, with the envelope then being closed by reversing the drive direction of the motor 10 in order to cause it to pass back at least partially between the rolls 5A and 5B. The envelope is ejected by reversing the drive direction of the motor 10 a second time.

In this machine, as in machines of a different type, the filling position is a defined position in which successive envelopes must be stopped for operations directly connected with filling them, such as the operations of opening the body of an envelope and the end of document insertion, and the same applies to subsequent operations such as moistening the flap, closing the envelope, and ejecting it.

The machine is also fitted with positioning control apparatus of the present invention, in particular for stopping envelopes accurately in the filling position. This stop position is defined relative to the wheels 3A and 3B and corresponds to an accurate stop point on the path 2 for the leading edges of the envelopes or else for the fold lines between the envelope bodies and their open flaps.

The control apparatus includes a first position detector 20 mounted upstream from the stuffing station 3 on the path 1. This detector is placed at a location in which access is as easy as possible and without taking account of its precise distance from the stop point. It is constituted by a pair of photoelectric cells mounted separately on opposite sides of the path 1.

The apparatus also includes a second position detector 21 which may be mounted upstream or downstream from the stop point or from the first detector, but it is at a known distance relative to the stop point. It is installed at a location which is relatively clear and unlikely to give rise to a jam, and where the side plates of the machine are particularly suitable for mounting it directly on the envelope trajectory. This second detector is shown as being placed downstream from the wheels 3A and 3B. It is advantageously constituted by an optoelectronic fork carried by one of the side plates of the machine.

The control apparatus also includes a control circuit 22 coupled to a sensor 23 for sensing unit displacement steps of the envelopes and which detects the steps of the motor 10, or preferably the steps of an encoder driven by an additional control motor (not shown) for applying various mechanical control signals to the machine by means of a cam shaft driven thereby. In the control apparatus, a memory 24 serves to store a stop control parameter P for each envelope in the filling position. An algebraic processing unit 25 co-operates with the control circuit 22 to derive the parameter P. This processing unit and the control circuit are preferably constituted by means of a microprocessor. A program memory 26 controls the microprocessor to define the parameter P from initial data N constituted by the number of steps from the sensor 23 corresponding to the distance between the detector 21 and the stop point.

The control parameters are determined and loaded into the memory 24 during an initialization cycle defined by the control program using an envelope driven along the paths 1 and 2 but without the desired stops. During this cycle, the control circuit counts the number of sensor steps between the moments when the front edge of the envelope passes each of the detectors 20 and 21. This count number is written n, and the processor circuit then calculates the parameter P using a program which takes account of the positioning of the detector 21. If the detector 21 is between the stop position and the detector 20, then $P=n+N$; if the detector 21 is upstream from the detector 20, then $P=N-n$; and if the detector 21 is downstream from the stop position, then $P=n-N$.

The control program also serves to take account of the fact that the definition of N relates to the leading edge of envelopes or to the trailing edge or fold line between the bodies and the flaps of the envelopes, and is capable of defining the control parameter P for the edge other than that assumed by N. To this end, the processor unit may correct the value of the parameter P as derived and stored as a function of the defined length of standardized envelopes.

More advantageously, the control program also defines a learning cycle using a closed envelope driven along the paths 1 and 2, and serving to measure the length of a particular type of envelope being used. During the learning cycle, the control circuit 22 counts the number of steps from the sensor 23 between the moments when the leading edge and the rear edge pass the detector 21. This count number is written l, and the processing unit corrects the stored parameter P by adding or subtracting the number n therefrom, as appropriate.

Thus, each time the user changes envelope format, the stored parameter P can automatically be corrected by requesting learning mode. The machine can thus be adapted to different types of envelope.

In addition, this measurement of envelope length as performed by the control circuit may also be used to define the maximum length of folded documents and thus enable the folding means fitted on or coupled to the path 7 to be suitably adjusted.

Once the parameter P has been derived and optionally corrected, it is used to determine other, similar parameters for controlling reversing of a filled envelope by reversing the drive direction of the motor 10, and then for controlling ejection of the closed envelope by reversing the drive direction of the motor a second time. These parameters may be calculated by adding defined numbers of steps from the counter 23 to the parameter P.

In a variant, as shown in the FIGURE, the stop control parameter for the filled envelope at one or other of the reversals of the drive direction of the motor 10 may be derived in the same manner as the stop control parameter P for the filling position, by means of two position detectors and the circuits 22, 23, and 25. The second above-mentioned detector 21 may be used in common for deriving all of the parameters.

In the machine shown, this same control apparatus is further adapted to control the stopping of each document at the end of its insertion into the envelope which receives it. To this end, the control apparatus further includes a position detector 30 mounted on the path 7 downstream from the stuffing station 3. The detector 30 is a detection lever and the associated sensor is not shown. Advantageously, the second detector 21 is also used with the detector 30 for deriving a document stop control parameter written Pd during the initialization cycle which is repeated for documents with a folded document travelling along the paths 7 and 2 but without it being inserted in an envelope.

This parameter Pd is derived in exactly the same way as the parameter P. It should merely be observed that the initial value to be taken into account in these calculations is the number Nd of steps counted by the sensor 23 corresponding to the distance between the detector 21 and the desired stop point for the rear edge of the document in the vicinity of the wheels 3A and 3B.

I claim:

1. Apparatus for controlling the positioning of articles on a path, the apparatus comprising means for driving the articles along the path, a first position detector mounted on the path upstream from a desired stop position, a sensor for sensing unit displacement steps of the articles, memory means for storing a control parameter P, and a displacement control circuit coupled to said first detector to be triggered thereby, and to said sensor for causing an article to be stopped P sensor steps after triggering, the said apparatus being characterized in that said first detector (20) is mounted at a noncritical distance from said stop point, and said apparatus further includes a second position detector (21) mounted on said path (2) at a position which may be upstream or downstream from said first detector and from said desired stop point, but which is at a distance that is uniquely known and referenced relative to the stop point, said distance being equal to a number N of sensor steps from said stop point, and an initialization circuit including processor means (25) coupled to the control circuit (22) and to the memory means (24) and also to control means (26) for deriving said parameter P during an initialization cycle using one of the articles driven along the path, on the basis of said number N and on the basis of a number n of sensor steps measured between said article being detected by one of the two position detectors (21, 22) and then by the other, with the derived parameter P being loaded in the memory means (24).

2. Apparatus according to claim 1, characterized in that said processor means (25) are initially conditioned by the position of said second detector relative to the position of said first detector and/or the stop position to define the signs attributed to the numbers N and n for calculating the parameter P.

3. Apparatus according to claim 2, characterized in that said control circuit and said processor means are constituted by a microprocessor.

4. Apparatus according to claim 2, characterized in that said control means (26) further provide a correction to said derived parameter P, using the value in sensor steps of the length l of the articles, to trigger said control circuit (22) on detection of the leading edge of the article by the first detector and to cause the other edge to stop at the stop point.

5. Apparatus according to claim 4, characterized in that said apparatus further includes means for measuring the length of articles, said measuring means being constituted by said second detector (21), said control circuit (22), and the control means (26), for measuring the length l during the opening cycle using one of the articles driven along said path, and by counting steps from the sensor (23) between detecting the leading edge and detecting the trailing edge of said article by means of the second detector (21).

6. Apparatus according to claim 2, installed in a mail processing machine for causing envelopes driven along an envelope path to be stopped in a stuffing station (3) of the machine in a defined envelope-filling position, said apparatus further including a third position detector (3) on the path for documents to be stuffed into each envelope in the filling position, the third position detector being disposed upstream from a stop point for documents at the end of insertion into an envelope, and a fourth position detector (21) mounted at a known referenced distance Nd steps of the sensor (23) from the document stop point, said third and fourth detectors being connected to the control circuit (22) for deriving a stop control parameter Pd for each document during an initialization cycle using one of the documents driven along the document path, and on the basis of the number Nd and the number of sensor steps measured between the documents being detected by one of the third and fourth detectors, and then in the other one thereof.

7. Apparatus according to claim 6, characterized in that the fourth detector is constituted by said second detector (21) mounted downstream from the stuffing station (3).

* * * * *